US007197857B1

(12) United States Patent
Alvarado

(10) Patent No.: US 7,197,857 B1
(45) Date of Patent: Apr. 3, 2007

(54) MOBILE HOME SKIRT ANCHOR MOUNTING BRACKET

(76) Inventor: Pete M. Alvarado, 503 N. St., Bayard, NM (US) 88023

( * ) Notice: Subject to any disclaimer, the term of this patent is extended or adjusted under 35 U.S.C. 154(b) by 546 days.

(21) Appl. No.: 10/671,962

(22) Filed: Sep. 26, 2003

(51) Int. Cl.
*E04C 5/00* (2006.01)

(52) U.S. Cl. ..... 52/702; 52/714; 52/715; 52/235; 52/169.12

(58) Field of Classification Search ..... 52/169.12, 52/DIG. 3, 702, 714, 715, 235, 92.2, 506.06, 52/509, 562; 248/301, 339, 340
See application file for complete search history.

(56) References Cited

U.S. PATENT DOCUMENTS 950,361 A * 2/1910 Woods ..... 248/201
3,295,287 A * 1/1967 Pasquale ..... 52/714
5,009,051 A * 4/1991 Trezza ..... 52/410
6,931,813 B2 * 8/2005 Collie ..... 52/713

* cited by examiner

*Primary Examiner*—Basil Katcheves

(57) ABSTRACT

Mobile home skirt anchor mounting brackets permit standard 2 by 4s to be mounted on the front portion of a common cinderblock to provide a continuous surface to anchor skirting on mobile homes. A top member 12 has one side of a first downward flange attached to one end and one side of a second downward flange attached to its opposing end. A horizontal flange connects one side of a vertical flange to the opposing side of the second downward flange. Fastening holes are present in the middle of the vertical flange. The first downward flange, top member, and second downward flange are adapted to be seated over the top of a cinderblock. The second downward flange, horizontal flange, and vertical flange are adapted to mount the ends of a pair of adjacent 2 by 4s.

18 Claims, 2 Drawing Sheets

MOBILE HOME SKIRT ANCHOR MOUNTING BRACKET

BACKGROUND OF THE INVENTION

1. Field of the Invention

The present invention relates to a mobile home skirt anchor mounting bracket for use in connection with mobile home skirting. The mobile home skirt anchor mounting bracket has particular utility in connection with permitting standard 2 by 4s to be mounted on the front portion of a common cinderblock to provide a continuous surface to anchor skirting on mobile homes.

2. Description of the Prior Art

Mobile home skirt anchor mounting brackets are desirable for permitting standard 2 by 4s to be mounted the front portion of a common cinderblock to provide a continuous surface to anchor skirting on mobile homes. Mobile home supported by concrete blocks or jacks have always been highly vulnerable to damage or destruction by high winds even when tie-downs are used. The open space beneath mobile homes allows excessive air circulation that can cause drafts and a dangerous lifting effect in strong winds. Furthermore, the open space can allow trash to drift and collect beneath the home, causing a health and fire hazard as well as unsightly appearance. Mobile homes can be provided with skirting to shield the open area beneath the home from the weather. To be effective and satisfactory, mobile home skirting must be easily removed and stored when the mobile home is prepared for transport. Traditional methods of attaching skirts to mobile homes involve the staking of brackets into the ground. However, this process is time-consuming and therefore expensive, and leaves the wooden stakes vulnerable to rotting, in which case the skirt is not supported. Mobile home skirt anchor mounting brackets overcome these difficulties by providing an easily installed support for mobile home skirting that is considerably less vulnerable to rotting and warping because the wooden parts are not in contact with the ground.

The use of mobile home skirting systems is known in the prior art. For example, U.S. Pat. No. 4,841,691 to Stoecker discloses a mobile home skirting system. However, the Stoecker '691 patent does not fit over a cinderblock, and has further drawbacks of not being of one-piece construction.

U.S. Pat. No. 5,690,305 to Perkins discloses a bracket for positioning skirting on a manufactured building that attaches a skirt to a building. However, the Perkins '305 patent does not fit over a cinderblock, and additionally is not of one-piece construction.

Similarly, U.S. Pat. No. 5,014,948 to Asaro et al. discloses an article support apparatus that enables securement and support of various articles thereon. However, the Asaro et al. '948 patent does not have fastening holes, and cannot receive one or more 2 by 4s while fitting over a cinderblock.

In addition, U.S. Pat. No. 5,810,304 to Lehrman discloses an ironing board holder that suspends an ironing board. However, the Lehrman '304 patent does not have fastening holes, and also is not of one-piece construction.

Furthermore, U.S. Pat. No. 5,738,319 to Grassi discloses an adjustable planter box hanger that hangs a planter box in a selected angular position from a support structure. However, the Grassi '319 patent does not have fastening holes, and further lacks one-piece construction.

U.S. Pat. No. 4,738,061 to Herndon discloses a foundation system for manufactured homes that permanently installs manufactured homes on footings set into the ground.

However, the Herndon '061 patent does not fit over a cinderblock, and has the additional deficiency of not being of one-piece construction.

Lastly, United States Patent Application Publication No. 2002/0104937 by Avinger discloses an adjustable wreath hanger that supports an object such as a decorative wreath or garland against the front surface of a door, over a cemetery headstone, or the like. However, the Avinger 2002/0104937 patent application publication is not of one-piece construction, and omits fastening holes.

While the above-described devices fulfill their respective, particular objectives and requirements, the aforementioned patents do not describe a mobile home skirt anchor mounting bracket that allows permitting standard 2 by 4s to be mounted on the front portion of a common cinderblock to provide a continuous surface to anchor skirting on mobile homes. The Stoecker '691 patent, the Perkins '305 patent, and the Herndon '061 patent make no provision for fitting over a cinderblock. The Stoecker '691 patent, the Perkins '305 patent, the Lehrman '304 patent, the Grassi '319 patent, the Herndon '061 patent, and the Avinger 2002/0104937 patent application publication are not of one-piece construction. The Asaro et al. '948 patent, the Lehrman '304 patent, the Grassi '319 patent, and the Avinger 2002/0104937 patent application publication lack fastening holes. The Asaro et al. '948 patent cannot receive one or more 2 by 4s while fitting over a cinderblock.

Therefore, a need exists for a new and improved mobile home skirt anchor mounting bracket that can be used for permitting standard 2 by 4s to be mounted on the front portion of a common cinderblock to provide a continuous surface to anchor skirting on mobile homes. In this regard, the present invention substantially fulfills this need. In this respect, the mobile home skirt anchor mounting bracket according to the present invention substantially departs from the conventional concepts and designs of the prior art, and in doing so provides an apparatus primarily developed for the purpose of permitting standard 2 by 4s to be mounted on the front portion of a common cinderblock to provide a continuous surface to anchor skirting on mobile homes.

SUMMARY OF THE INVENTION

In view of the foregoing disadvantages inherent in the known types of mobile home skirting systems now present in the prior art, the present invention provides an improved mobile home skirt anchor mounting bracket, and overcomes the above-mentioned disadvantages and drawbacks of the prior art. As such, the general purpose of the present invention, which will be described subsequently in greater detail, is to provide a new and improved mobile home skirt anchor mounting bracket which has all the advantages of the prior art mentioned heretofore and many novel features that result in a mobile home skirt anchor mounting bracket which is not anticipated, rendered obvious, suggested, or even implied by the prior art, either alone or in any combination thereof.

To attain this, the present invention essentially comprises a top member with a first downward flange connected to one end and a second downward flange connected to its opposing end. A horizontal flange has one side connected to the opposing end of the second downward flange and a vertical flange connected to its opposing side. A fastening hole is present in the middle of the vertical flange.

There has thus been outlined, rather broadly, the more important features of the invention in order that the detailed description thereof that follows may be better understood and in order that the present contribution to the art may be better appreciated.

The invention may also include the top member, the first downward flange, and the second downward flange being adapted to fit over a cinderblock. The second downward flange, the horizontal flange, and the vertical flange may be adapted to receive at least one 2 by 4. The mobile home skirt anchor mounting bracket may be of one-piece construction. The fastening hole may be adapted to receive a nail or a screw. The top member may be about 8¾ in. long, about 8 in. wide, and about ⅜ of an inch thick. The first downward flange may be about 4 in. wide, 8 in. long, and about ⅜ of an inch thick. The second downward flange may be about 6 in. wide, about 8 in. long, and about ⅜ of an inch thick. The horizontal flange may be about 1½ inches wide, about 8 in. long, and about ⅜ of an inch thick. The vertical flange may be about 2 in. wide, about 8 in. long, and about ⅜ of an inch thick. The fastening hole may be about ⅛ of an inch in diameter. The mobile home skirt anchor mounting bracket may be made of plastic, steel, aluminum, titanium, wood, or carbon-fiber composite. There may be a plurality of fastening holes present in the middle of the vertical flange. The second downward flange, the horizontal flange, and the vertical flange may be adapted to mount the ends of a pair of adjacent 2 by 4s. The first downward flange, the top member, and the second downward flange may be adapted to be seated over the top of a cinderblock. The mobile home skirt anchor mounting bracket may be about ⅜ of an inch thick. The mobile home skirt anchor mounting bracket may be made of polyethylene. The invention may comprise an improvement to a cinderblock wherein the top member has its bottom frictionally engaged with the top of the cinderblock, the first downward flange has its bottom frictionally engaged with one of the sides of the cinderblock, and the second downward flange has its bottom frictionally engaged with the opposing side of the cinderblock. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mobile home skirt anchor mounting bracket that has, all of the advantages of the prior art mobile home-skirting systems and none of the disadvantages.

It is another object of the present invention to provide a new and improved mobile home skirt anchor mounting bracket that may be easily and efficiently manufactured and marketed.

An even further object of the present invention is to provide a new and improved mobile home skirt anchor mounting bracket that has a low cost of manufacture with regard to both materials and labor, and which accordingly is then susceptible of low prices of sale to the consuming public, thereby making such mobile home skirt anchor mounting bracket economically available to the buying public.

Still another object of the present invention is to provide a new mobile home skirt anchor mounting bracket that provides in the apparatuses and methods of the prior art some of the advantages thereof, while simultaneously overcoming some of the disadvantages normally associated therewith.

Even still another object of the present invention is to provide a mobile home skirt anchor mounting bracket for permitting standard 2 by 4s to be mounted on the front portion of a common cinderblock to provide a continuous surface to anchor skirting on mobile homes. This allows skirting to be attached to a mobile home.

Still yet another object of the present invention is to provide a mobile home skirt anchor mounting bracket for permitting standard 2 by 4s to be mounted on the front portion of a common cinderblock to provide a continuous surface to anchor skirting on mobile homes. This makes it possible to install the mobile home skirt anchor mounting bracket easily.

An additional object of the present invention is to provide a mobile home skirt anchor mounting bracket for permitting standard 2 by 4s to be mounted on the front portion of a common cinderblock to provide a continuous surface to anchor skirting on mobile homes. This prevents rotting and warping of the 2 by 4s.

A further object of the present invention is to provide a mobile home skirt anchor mounting bracket for permitting standard 2 by 4s to be mounted on the front portion of a common cinderblock to provide a continuous surface to anchor skirting on mobile homes. This allows nails or screws to be used to attach 2 by 4s to the mobile home skirt anchor mounting bracket.

Lastly, it is an object of the present invention to provide a new and improved mobile home skirt anchor mounting bracket for permitting standard 2 by 4s to be mounted on the front portion of a common cinderblock to provide a continuous surface to anchor skirting on mobile homes.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description males reference to the annexed drawings wherein.

The same reference numerals refer to the same parts throughout the various figures.

DESCRIPTION OF THE CURRENT EMBODIMENT

Figure 1:
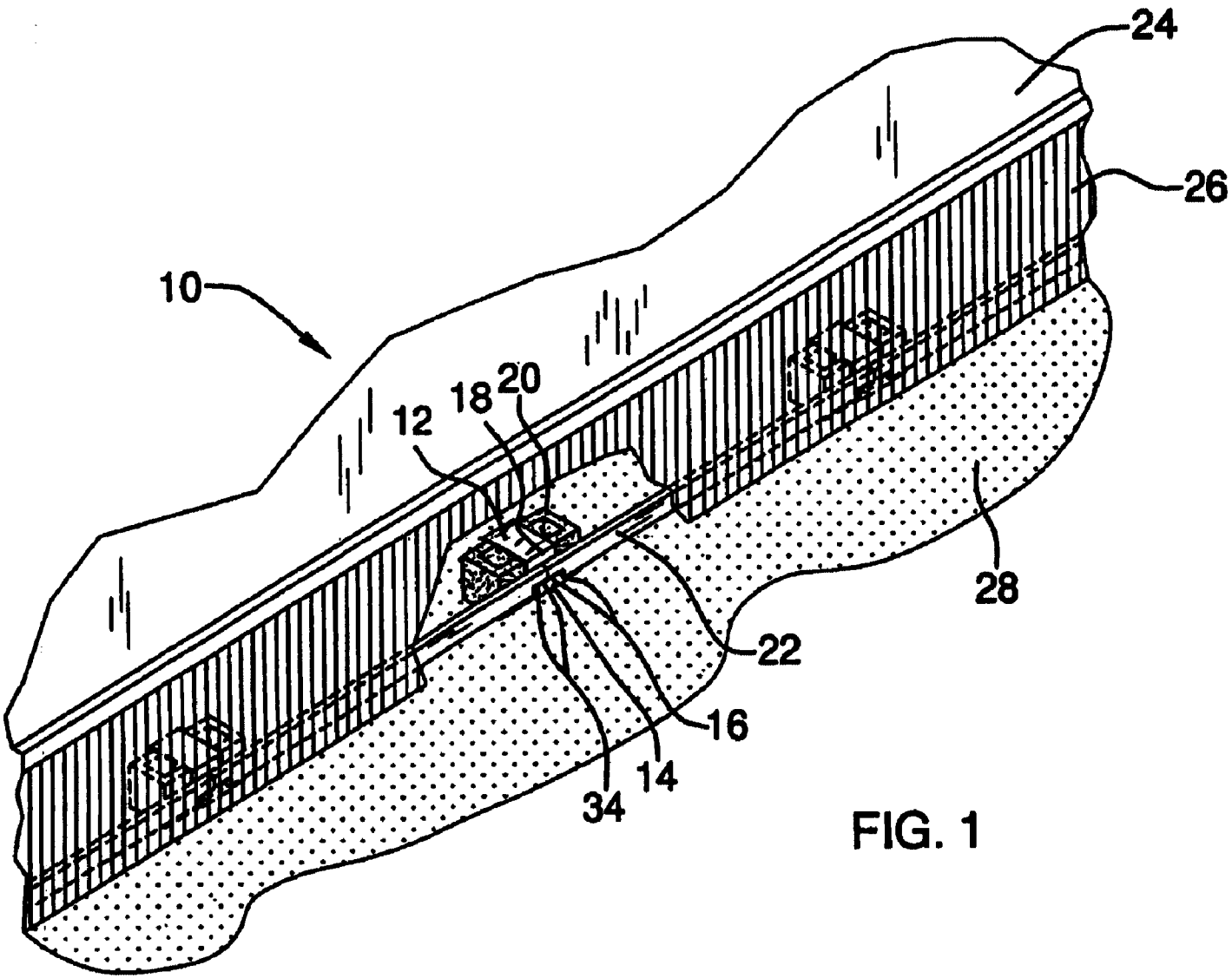
FIG. 1 is a top perspective view of the current embodiment of the mobile home skirt anchor mounting bracket constructed in accordance with the principles of the present invention.
Figure 2:
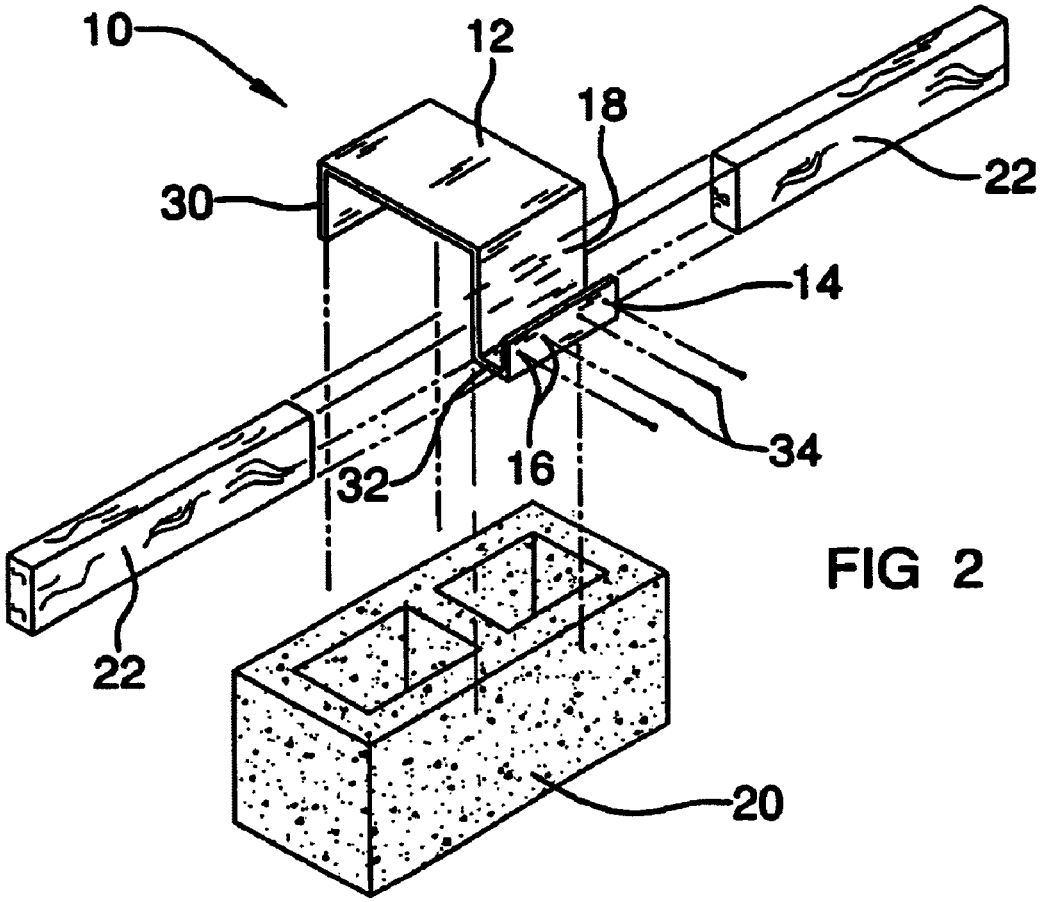
FIG. 2 is a top perspective exploded view of the mobile home skirt anchor mounting bracket of the present invention.
Figure 3:
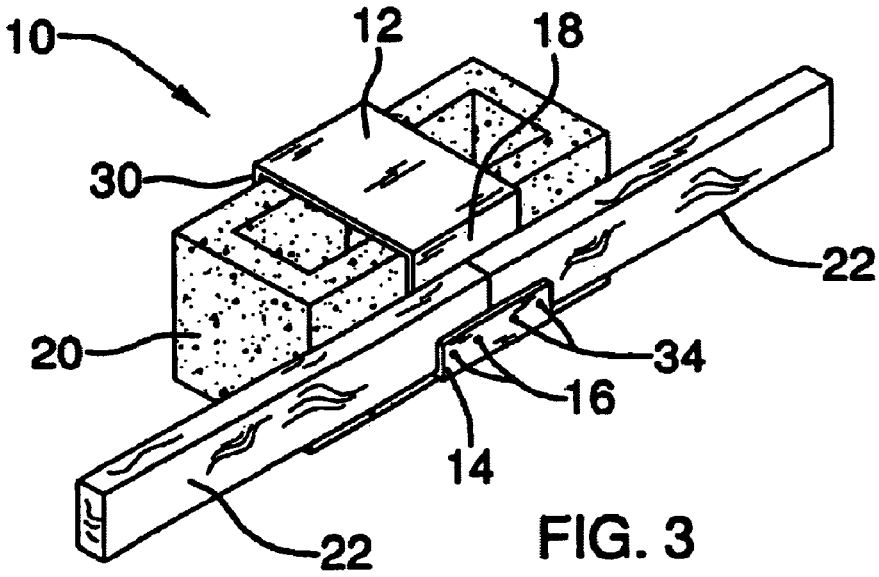
FIG. 3 is a top perspective view of the mobile home skirt anchor mounting bracket of the present invention.

Referring now to the drawings, and particularly to FIGS. 1–3, a current embodiment of the mobile home skirt anchor mounting bracket of the present invention is shown and generally designated by the reference numeral 10.

In FIG. 1, a new and improved mobile home skirt anchor mounting bracket 10 of the present invention for permitting standard 2 by 4s to be mounted on the front portion of a common cinderblock to provide a continuous surface to anchor skirting on mobile homes is illustrated and will be described. More particularly, the mobile home skirt anchor mounting bracket 10 has a top member 12 with a second downward flange 18 attached to one end seated over the top of a cinderblock 20. Nails 34 driven through fastening holes 16 in vertical flange 14 allow the ends if a pair of adjacent 2 by 4s 22 to be mounted by the mobile home skirt anchor mounting bracket 10 onto the cinderblock 20. A series of cinderblocks 20, mobile home skirt anchor mounting brackets 10, and 2 by 4s 22 provide a continuous surface to anchor skirt 26 to mobile home 24. The bottom of skirt 26 rests against the ground 28 to prevent wind from blowing underneath the mobile home 24, thereby preventing the deposit of trash and debris underneath the home and reducing the wind's potentially dangerous lifting effect. The mobile home skirt anchor mounting brackets 10 hold the wooden 2 by 4s 22 off of the ground 28, thereby preventing warping and rotting of the 2 by 4s 22. In the current embodiment, the mobile home skirt anchor mounting bracket 10 is made of ⅜ of an inch thick polyethylene and is of one-piece construction. The fastening holes 16 are ⅛ of an inch in diameter in the current embodiment. Note that the cinderblocks 20, 2 by 4s 22, mobile home 24, skirt 26, ground 28, and nails 34 are for illustrative purposes only and are not part of the current invention.

Moving on to FIG. 2, a new and improved mobile home skirt anchor mounting bracket 10 of the present invention for permitting standard 2 by 4s to be mounted on the front portion of a common cinderblock to provide a continuous surface to anchor skirting on mobile homes is illustrated and will be described. More particularly, the mobile home skirt anchor mounting bracket 10 has a top member 12 with a first downward flange 30 attached to one end and one side of a second downward flange 18 attached to its opposing end. A horizontal flange 32 connects one side of a vertical flange 14 to the opposing side of the second downward flange 18. A plurality of fastening holes 16 are present in the middle of the vertical flange 14 to receive nails 34. In the current embodiment, the first downward flange 30, top member 12, and second downward flange 18 are adapted to be seated over the top of a cinderblock 20, and the second downward flange 18, horizontal flange 32, and vertical flange 14 are adapted to mount the ends of a pair of adjacent 2 by 4s. In the current embodiment, the top member is about 8¾ inches long, about 8 in. wide, and about ⅜ of an inch thick, the first downward flange is about 4 in. wide, 8 in. long, and about ⅜ of an inch thick, the second downward flange is about 6 in. wide, about 8 in. long, and about ⅜ of an inch thick, the horizontal flange is about 1½ inches wide, about 8 in. long, and about ⅜ of an inch thick, and the vertical flange is about 2 in. wide, about 8 in. long, and about ⅜ of an inch thick. The mobile home skirt anchor mounting bracket 10 is illustrated with lines depicting how it is installed over the top of cinderblock 20 and mounts the ends of a pair of adjacent 2 by 4s to the cinderblock 20. Note that the cinderblock 20, 2 by 4s 22, and nails 34 are for illustrative purposes only and are not part of the current invention.

Continuing with FIG. 3, a new and improved mobile home skirt anchor mounting bracket 10 of the present invention for permitting standard 2 by 4s to be mounted on the front portion of a common cinderblock to provide a continuous surface to anchor skirting on mobile homes is illustrated and will be described. More particularly, the mobile home skirt anchor mounting bracket 10 is shown in use with the top member 12, first downward flange 30, and second downward flange 18 seated over the top of cinderblock 20. Second downward flange 18, horizontal flange 32 (not visible), and vertical flange 14 mount 2 by 4s 22 to the cinderblock 20. Nails 34 driven through fastening holes 16 in the ends of the 2 by 4s 22 secure the 2 by 4s 22 to the mobile home skirt anchor mounting bracket 10.

In use, it can now be understood that the user places the first downward flange 30, top member 12, and second downward flange 18 over the top of a cinderblock 20 so that the bottom of the first downward flange 30 is frictionally engaged with one side of the cinderblock 20, the bottom of the top member 12 is frictionally engaged with the top of the cinderblock 20, and the bottom of the second downward flange 18 is frictionally engaged with the opposing side of the cinderblock 20. The user repeats this process using additional mobile home skirt anchor mounting brackets 10 and cinderblocks 20 until the desired number of mobile home skirt anchor mounting brackets 10 are in place. The user then places the ends of a pair of 2 by 4s between the second downward flange 18 in the vertical flange 14 so that the 2 by 4s rest against the horizontal flange 32. Nails 34 are then driven through the fastening holes 16 into the 2 by 4s 22 to secure them in place. The previous two steps are repeated until all of the 2 by 4s 22 are mounted on the cinderblocks 20 by the mobile home skirt anchor mounting brackets 10. After all of the 2 by 4s 22 are installed, the user can then hang skirt 26 from the 62 by 4s 22. The process is reversed to prepare the mobile home 24 for relocation.

While a current embodiment of the mobile home skirt anchor mounting bracket has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the polyethylene mobile home skirt anchor mounting bracket described. Also, the wooden 2 by 4s may also be made of plastic, steel, aluminum, titanium, or carbon fiber composite. Furthermore, a wide variety of thicknesses may be used instead of the ⅜ of an inch thickness described.

Therefore, the foregoing is considered as illustrative only of the principles of the invention. Further, since numerous modifications and changes will readily occur to those skilled in the art, it is riot desired to limit the invention to the exact construction and operation shown and described, and accordingly, all suitable modifications and equivalents may be resorted to, falling within the scope of the invention.

I claim:

1. A mobile home skirt anchor mounting bracket comprising:

a top member having opposing ends and a length;

a first downward flange having opposing sides with one side connected to one of said opposing ends of said top member;

a second downward flange having opposing ends with one of said opposing ends connected to one of said opposing ends of said top member opposite said first downward flange, wherein said length of said top member is equal to the width of a cinderblock having a first sidewall and a second sidewall having exterior surfaces such that when said top member is placed on top of said cinderblock, said first downward flange fits over said exterior surface of said first sidewall and said second downward flange fits over said exterior surface of said second sidewall;

a horizontal flange having opposing sides with one of said opposing sides connected to one of said opposing ends of said second downward flange opposite said top member;

a vertical flange having opposing sides and a middle with one of said opposing sides connected to one of said opposing sides of said horizontal flange opposite said downward flange; and a fastening hole wherein said middle of said vertical flange defines a hole therein to comprise said fastening hole.

2. The mobile home skirt anchor mounting bracket as defined in claim 1, wherein said second downward flange, said horizontal flange, and said vertical flange are adapted to receive at least one 2 by 4.

3. The mobile home skirt anchor mounting bracket as defined in claim 2, wherein said horizontal flange is about 1½ inches wide, about 8 in. long, and about ⅜ of an inch thick.

4. The mobile home skirt anchor mounting bracket as defined in claim 2, wherein said vertical flange is about 2 in. wide, about 8 in. long, and about ⅜ of an inch thick.

5. The mobile home skirt anchor mounting bracket as defined in claim 1, wherein said mobile home skirt anchor mounting bracket is of one-piece construction.

6. The mobile home skirt anchor mounting bracket as defined in claim 1, wherein said fastening hole is adapted to receive an object selected from the group consisting of nails and screws.

7. The mobile home skirt anchor mounting bracket as defined in claim 6, wherein said fastening hole is about ⅛ of an inch in diameter.

8. The mobile home skirt anchor mounting bracket as defined in claim 1, wherein said top member is about 8¾ in. long, about 8 in. wide, and about ⅜ of an inch thick.

9. The mobile home skirt anchor mounting bracket as defined in claim 1, wherein said first downward flange is about 4 in. wide, 8 in. long, and about ⅜ of an inch thick.

10. The mobile home skirt anchor mounting bracket as defined in claim 1, wherein said second downward flange is about 6 in. wide, about 8 in. long, and about ⅜ of an inch thick.

11. The mobile home skirt anchor mounting bracket as defined in claim 1, wherein said mobile home skirt anchor mounting bracket is selected from the group consisting plastic, steel, aluminum, titanium, wood, and carbon fiber composite.

12. A mobile home skirt anchor mounting bracket comprising:

a first downward flange having opposing sides;

a top member having opposing ends and a length with one of said opposing ends connected to one of said opposing sides of said first downward flange;

a second downward flange having opposing sides with one of said opposing sides connected to one of said opposing ends of said top member opposite said first downward flange wherein said length of said top member is equal to the width of a cinderblock having a first sidewall and a second sidewall having exterior surfaces such that when said top member is placed on top of said cinderblock, said first downward flange fits over said exterior surface of said first sidewall and said second downward flange fits over said exterior surface of said second sidewall;

a horizontal flange having opposing sides with one of said opposing sides connected to one of said opposing sides of said second downward flange opposite said top member;

a vertical flange having a middle and opposing sides with one of said opposing sides connected to one of said opposing sides of said horizontal flange opposite said second downward flange; and a plurality of fastening holes wherein said middle of said vertical flange defines holes therein to comprise said fastening holes.

13. The mobile home skirt anchor mounting bracket as defined in claim 12, wherein said mobile home skirt anchor mounting bracket is of one-piece construction.

14. The mobile home skirt anchor mounting bracket as defined in claim 12, wherein said second downward flange, said horizontal flange, and said vertical flange are adapted to mount the ends of a pair of adjacent 2 by 4s.

15. The mobile home skirt anchor mounting bracket as defined in claim 12, wherein said mobile home skirt anchor mounting bracket is about ⅜ of an inch thick.

16. The mobile home skirt anchor mounting bracket as defined in claim 12, wherein said mobile home skirt anchor mounting bracket is made of polyethylene.

17. A mobile home skirt anchor mounting bracket in combination with a cinderblock having a top and first and second opposing sides, the improvement which comprises:

a top member having opposing ends and a bottom with said bottom frictionally engaged with said top of said cinderblock;

a first downward flange having opposing sides and a bottom with one of said opposing sides connected to one of said opposing ends of said top member and said bottom frictionally engaged with said first opposing sides of said cinderblock;

a second downward flange having opposing sides and a bottom with one of said opposing sides connected to one of said opposing ends of said top member opposite said first downward flange and said bottom frictionally engaged with said second opposing side of said cinderblock;

a horizontal flange having opposing sides with one of said opposing sides connected to one of said opposing sides of said second downward flange opposite said top member;

a vertical flange having opposing sides and a middle with one of said opposing sides connected to one of said opposing sides of said horizontal flange opposite said second downward flange; and a plurality of fastening holes wherein said middle of said vertical flange defines holes therein to comprise said fastening holes.

18. The improvement to a cinderblock as defined in claim 17, wherein said second downward flange, said horizontal flange, and said vertical flange are adapted to mount the ends of a pair of adjacent 2 by 4s.

* * * * *